US005501091A

United States Patent [19]

Hayashi

[11] Patent Number: 5,501,091

[45] Date of Patent: Mar. 26, 1996

[54] METHOD AND APPARATUS FOR ELONGATING METAL TUBES BY MEANS OF A MANDREL MILL

[75] Inventor: Chihiro Hayashi, Takarazuka, Japan

[73] Assignee: Sumitomo Metal Industries, Ltd., Osaka, Japan

[21] Appl. No.: 155,844

[22] Filed: Nov. 23, 1993

[30] Foreign Application Priority Data

Dec. 11, 1992 [JP] Japan ..... 4-331820

[51] Int. Cl.[6] ..... B21B 17/02

[52] U.S. Cl. ..... 72/13.4; 72/208; 72/370

[58] Field of Search ..... 72/21, 208, 209, 72/370

[56] References Cited

FOREIGN PATENT DOCUMENTS

| | | | |
|---|---|---|---|
| 2366071 | 4/1978 | France . | |
| 2441438 | 6/1980 | France . | |
| 2457906 | 6/1976 | Germany | 72/209 |
| 57-4309 | 1/1982 | Japan | 72/208 |
| 59-94516 | 5/1984 | Japan . | |
| 60-206507 | 10/1985 | Japan . | |
| 2089702 | 6/1982 | United Kingdom . | |

*Primary Examiner*—Lowell A. Larson
*Assistant Examiner*—Thomas C. Schoeffler
*Attorney, Agent, or Firm*—Burns, Doane, Swecker & Mathis

[57] ABSTRACT

In a method of elongating a metal tube by means of a mandrel mill, a tapered mandrel bar is inserted into a hollow piece and the feeding speed of the mandrel bar is controlled so as to change the length by which the mandrel bar projects beyond the delivery end of the final stand of the mandrel mill at the point of time when the leading end of the hollow shell is gripped by the rolls in the final stand. As a result, the wall thickness of the hollow shell is altered to permit the rolling of hollow shells of many sizes with different wall thicknesses using a single mandrel bar.

18 Claims, 4 Drawing Sheets

METHOD AND APPARATUS FOR ELONGATING METAL TUBES BY MEANS OF A MANDREL MILL

BACKGROUND OF THE INVENTION

The present invention relates to an elongating method that employs a mandrel mill for the manufacture of metal tubes, in particular seamless tubes, as well as an apparatus for implementing that method. The following description is directed to seamless steel tube as a typical example of "metal tube".

The steps for the production of a seamless steel tube of the prior art are first described below.

As shown in FIG. 1, facilities commonly employed in the art comprise a rotary hearth furnace A, a piercing mill (Mannesmann piercer) B, an elongator (mandrel mill) C, a reheating furnace D, and a reducing mill (stretch reducer) E.

A round steel billet 1 emerging from the heating furnace A is first pierced with the Mannesmann piercer B. The thus rolled hollow piece 2, which is rather short and thick-walled, is fed to the mandrel mill C, in which the hollow piece, with a mandrel bar 3 inserted, is continuously rolled between grooved rolls 4 to reduce its wall thickness whereas its length is elongated to produce a hollow shell 5.

Since the temperature of the hollow shell 5 drops during the rolling operation, the shell is reheated in the reheating furnace D before it is sent to the reducing mill (stretch reducer) E where its outside diameter is reduced to a predetermined final dimension with rolls 6.

The operation on the mandrel mill C at the elongating stage of this production process is further described below.

Mandrel mill C is a rolling mill on which the hollow piece 2 that has been pierced with the Mannesmann piercer B and which has the mandrel bar 3 inserted thereinto is subjected to an elongating action.

The mill usually consists of 6–8 stands that are each inclined at 45° to the horizontal and which are staggered from each other by 90° in phase; this "X" mill structure is common in the art. As the hollow piece 2 is passed through all stands in the mandrel mill C, its length is elongated by a factor of about 4 times at maximum.

The early type of mandrel mill was a "full floating" mandrel mill which, as mentioned above, was used in continuous rolling of a hollow piece 2 by means of grooved rolls 4, with mandrel bar 3 inserted into the hollow piece. In the period from 1977 to 1978, a "retained" (also known as "restrained") mandrel mill was developed and commercialized. This new type of mandrel mill which can achieve higher efficiency and quality was introduced at plants in many countries of the world to manufacture small and medium-diameter seamless steel tubes.

In the retained mandrel mill, mandrel bar retainer C-1 retains or restrains the mandrel bar 3 from its rear end until the end of rolling. According to the manner in which the mandrel bar 3 is handled after the end of rolling, the retained mandrel mill is classified as a semi-floating type in which the mandrel bar 3 is released simultaneously with the end of rolling or as a full-retracting type in which the mandrel bar 3 is pulled back simultaneous with the end of rolling. The semi-floating type is common in the manufacture of small-diameter seamless steel tubes whereas the full-retracting type is common in the manufacture of medium or large-diameter seamless steel tubes.

In the full-retracting type, extractor C-3 is connected to the delivery end of mandrel mill C so that while a rolling operation is underway in mandrel mill C-2, the hollow shell 5 is extracted, or pulled out of the mandrel mill C-2 with the extractor C-3. If the temperature of the tube material emerging from the delivery end of the mandrel mill C-2 is sufficiently high, the reheating furnace D is unnecessary.

Thus, in the retained mandrel mill, whether it is of a full retracting type or a semi-floating type, the mandrel bar is retained and/or restrained from its rear end during rolling. Hence, the elongated hollow shell has such a nature as to readily separate from the mandrel bar, and a closed roll pass that has a correspondingly increased degree of roundness can be adopted, which contributes to a marked improvement in the circumferential uniformity of the wall thickness of the tube.

In an early full-floating mandrel mill, the direction of the frictional force acting on the inner surface of the tube varies constantly during the transient state, i.e., when the leading end of the tube is gripped by rolls or when the trailing end of the tube leaves the mill. As a result, a compressive force is said to act between stands to cause an undesired phenomenon called "stomach formation". This "stomach formation" problem has successfully been solved by the new retained mandrel mill since it enables a frictional force to keep on the inside surface of the shell at all times in a constant direction.

Thus, the use of the retained mandrel mill has been a solution to the "stomach formation" problem. However, all types of mandrel mills that are used today have a major problem that it is necessary to keep a huge number of mandrel bars in stock.

More specifically, the common practice with the mandrel mill, whether of a full-floating type, a semi-floating type, or a full-retracting type, is to adjust the wall thickness of the tube by changing the diameter of the mandrel bar while maintaining the roll opening, or the gap between the top and bottom grooved rolls at a constant level. Since the roll opening cannot be varied to adjust the wall thickness as in the case of rolling plates or strips, a huge number of mandrel bars must be made available at the shop in order to roll hollow shells of varying outside diameters over a wide range of wall thicknesses (including heavy and light-wall tubes).

The reason why wall thickness changes cannot be made with a mandrel mill by adjusting the roll opening is as follows.

The shape of a mandrel bar is a true circle whereas the shape of a roll pass is elliptic. Hence, the space between the roll pass and the mandrel bar will naturally be nonuniform in the circumferential direction. As a result, the wall thickness will increase in a position that is approximately 30°–45° inclined with respect to the oval direction of the roll pass, i.e., in a position at the point of wall thickness separation where the inner surface of the shell leaves the mandrel bar, so that the circumferential width of the roll pass will increase at the groove side and decrease at the flange side, thereby increasing the chance of projections forming on the inside surface of the tube at the flange side. A typical example of this phenomenon is shown in FIG. 2. Obviously, the tube wall 10 is provided with four inner projections 12 that are symmetric with respect to both the horizontal and the oval axis.

This problem generally called "quarter-projections" is inherent in mandrel mills and can be eliminated by a suitable pass design. However, if one attempts to alter the wall thickness by reducing the roll opening while using mandrel bars of the same diameter, the projections on the inner surface of the shell will appear further until the geometry of the tube is greatly deteriorated.

The common practice adopted today to change the wall thickness of a hollow shell with a mandrel mill, therefore, is to alter the diameter of the mandrel bar while maintaining the roll opening constant. This necessitates the use of a huge number of mandrel bars, and as many as 5000 mandrel bars are provided at a shop for producing small-diameter seamless steel tubes up to sizes of about 7 inches. For rolling seamless steel tubes ranging from small to medium or large size (around 5–16 inches), 10,000 mandrel bars must be provided. Hence, a very large automated warehouse becomes necessary just for keeping mandrel bars, and this increases not only the initial investment but also the running costs for the repair and maintenance of mandrel bars.

SUMMARY OF THE INVENTION

The principal object of the present invention is to provide a technology by which the above-described major problem of mandrel mills can be solved completely.

The present inventors conducted various studies in order to attain the above-described object. As a result, they conceived the idea of replacing straight mandrel bars of different diameters by mandrel bars with a linear or curved taper that are characterized by continuous changes in diameter in the longitudinal direction.

More specifically, given a constant roll opening, a mandrel bar having the necessary outside diameter for attaining the desired wall thickness is replaced by a tapered mandrel bar having the outside diameter in a certain portion, and the operation of elongation is allowed to end in a predetermined position for outside diameter. For this purpose, the feeding speed of the mandrel bar is properly controlled so that its outside diameter at the delivery end of the final stand will be equal to the desired dimension at the point of time when the leading end of the hollow shell has entered the final stand.

Thus, the present inventors learned that by adopting the means described above, hollow shells of various wall thickness can be produced using the same tapered mandrel.

The present invention has been accomplished on the basis of this finding.

The present invention provides a method of elongating a metal tube, and in particular a seamless steel tube by means of a mandrel mill, in which a hollow piece with a mandrel bar inserted is rolled through a series of rolling stands while the length of the hollow piece is elongated to provide a hollow shell, characterized in that a tapered mandrel bar is inserted into the hollow piece and the feeding speed of the mandrel bar is controlled so as to control the length by which the mandrel bar projects beyond the delivery end of the final stand at the point of time when the leading end of the hollow shell is gripped by the rolls in the final stand, whereby the wall thickness of the hollow shell is altered to permit the rolling of hollow shells of a plurality of sizes with different wall thicknesses using a single mandrel bar.

The feeding speed of the mandrel bar may be controlled in one of two manners.

In the first manner, the feed of the mandrel bar is ceased at the point of time when the leading end of the hollow shell is gripped by the rolls in the final stand. Thereafter, the elongating operation is continued until the trailing end of the hollow shell leaves the final stand with the roll opening being maintained.

However, if the feed of the mandrel bar is ceased during the operation of elongation on the mandrel mill, galling tends to occur on the inner surface of the shell on account of its friction against the mandrel bar. To avoid this problem, the roll opening may also be changed to effect wall thickness adjustment with the mandrel bar remaining afloat.

Therefore, in the second manner of controlling the feeding speed of the mandrel bar, a uniform wall thickness is assured for the hollow shell in the longitudinal direction by simultaneously increasing the roll openings in all stands so as to compensate for the amount of taper of the tapered mandrel bar in accordance with the length by which mandrel bar projects beyond the delivery end of the final stand at the point of time when the leading end of the hollow shell is gripped by the rolls in the final stand. Even after that, the feeding of the mandrel bar is continued as the feeding speed of the mandrel bar is controlled in such a way that the length by which the mandrel bar projects beyond the delivery end of the final stand will assume a predetermined length at the point of time when the trailing end of the hollow shell leaves the final stand.

In whichever manner the feeding speed is controlled, it is preferred for the purposes of the present invention to control and fine tune the rotating speeds of the rolls in each stand so as to provide a constant volume speed in accordance with the change in the cross-sectional area of the hollow shell in each stand.

In accordance with another aspect, the present invention provides an apparatus for elongating a metal tube that comprises a mandrel mill for implementing any one of the methods described above, the mandrel mill having a tapered mandrel bar and a mechanism for controlling the feeding speed thereof.

DESCRIPTION OF THE PREFERRED EMBODIMENTS

The present invention has been accomplished in order to solve all of the aforementioned problems involved in operation of a retained mandrel mill in the prior art. According to this invention, a longitudinally tapered mandrel bar is adopted and the feeding speed of the mandrel bar is controlled so as to control the length by which the mandrel bar projects beyond the delivery end of the final finishing stand at the point of time when the leading end of the hollow shell is gripped by the rolls in the final stand. If desired, the roll opening may be controlled. Because of these features, the present invention insures that hollow shells of many sizes with varying wall thicknesses can be elongated using a single mandrel bar.

The mechanism of action of the present invention is described below in greater detail with reference to the accompanying drawings.

Figure 1:
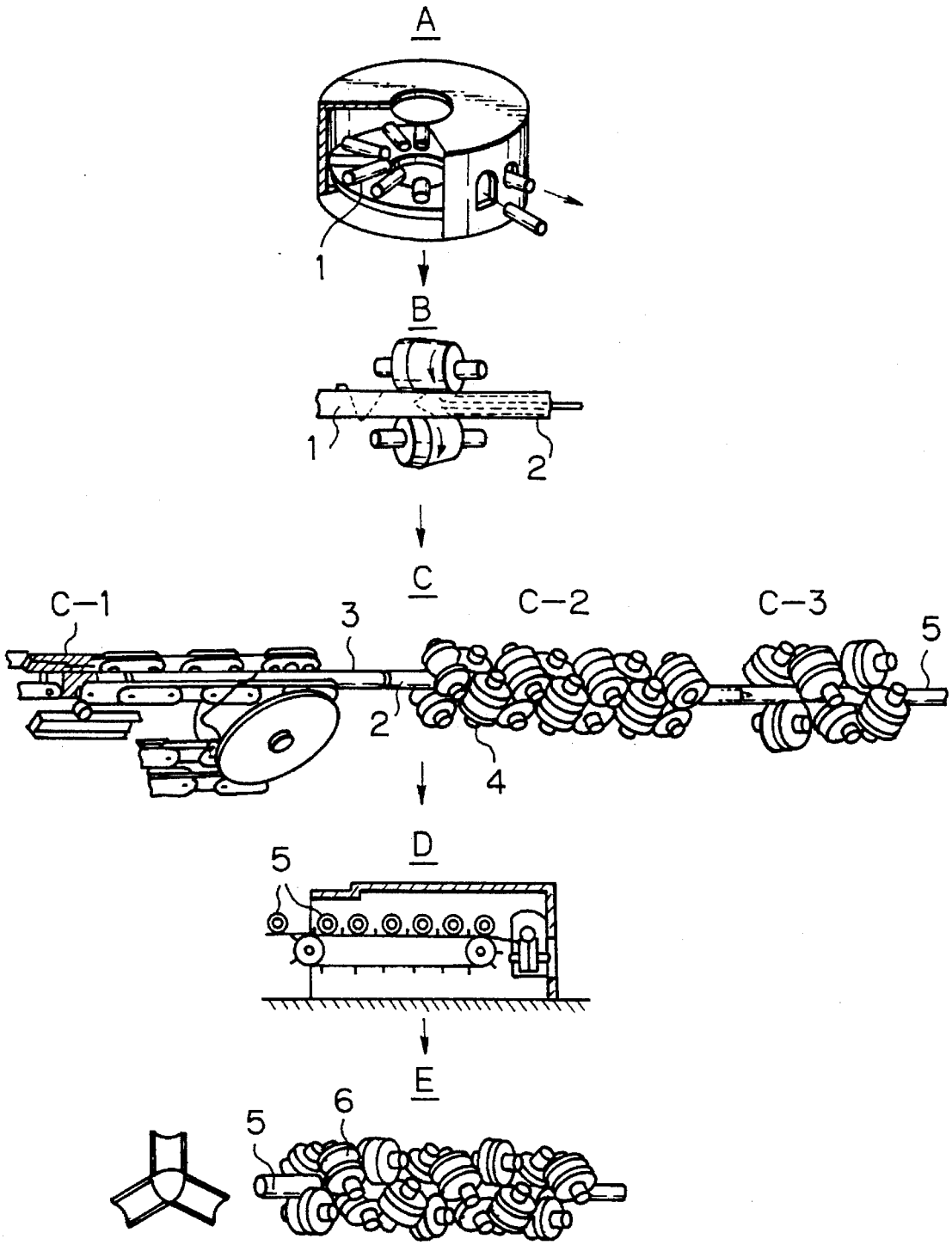
FIG. 1 is a flow sheet showing an example of a process for manufacturing seamless steel tubes.
Figure 2:
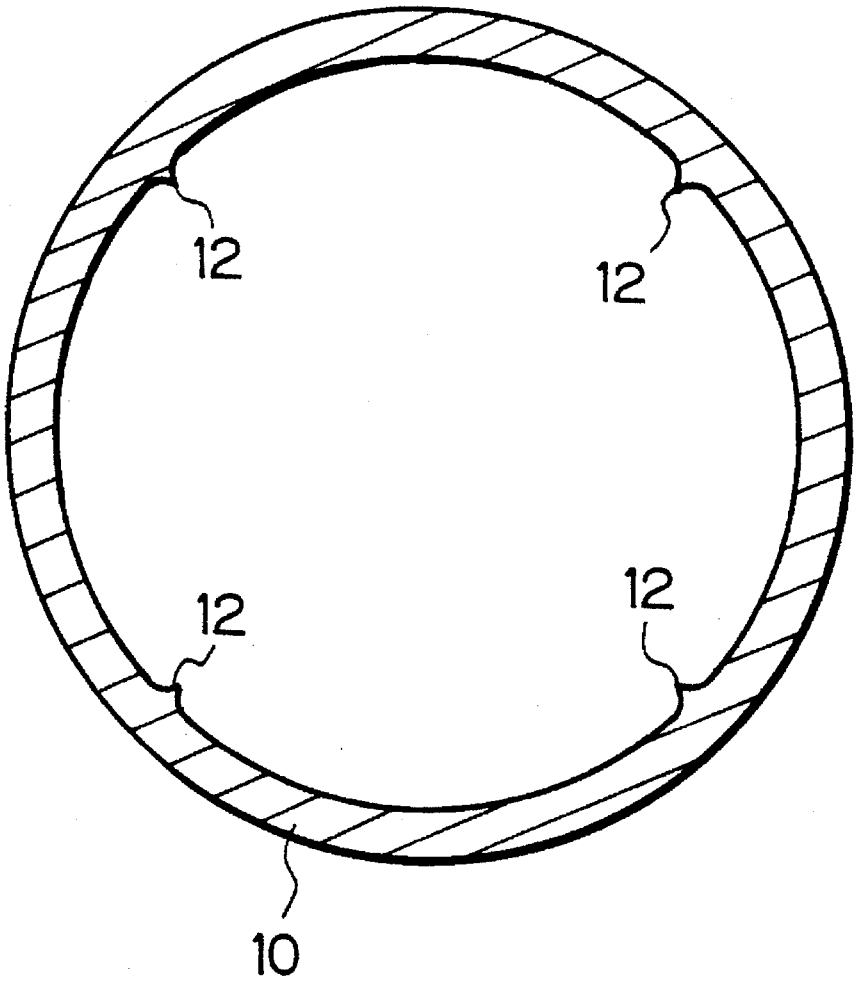
FIG. 2 is a sketch showing a characteristic profile of the inner surface of a seamless tube, non uniformness of which appears markedly when one attempts to change the wall thickness of the tube with a grooved roll fitted in a mandrel mill.

It should first be mentioned that in the present invention, metal tubes, and in particular, seamless steel tubes, are manufactured in accordance with the basic process scheme shown in FIG. 1, except that a tapered mandrel bar is used in mandrel mill (elongator) C. As in the case of the conventional retained mandrel mill, the tapered mandrel bar (indicated by 3 also in FIGS. 3 and 4) is retained and restrained from the rear by means of bar retainer C-1 which serves as a mechanism for controlling the feeding speed of the tapered mandrel bar 3. This feeding speed is controlled to be slower than the travelling speed of the hollow shell 5 at all times throughout the steady and transient states (the latter including the time when the leading end of the hollow shell is gripped by the rolls in the final stand and the time when the trailing end of the same hollow shell leaves the mill) so that the direction of the frictional force acting between the inside surface of the hollow shell and the mandrel bar will always be kept constant (invariable).

In the present invention, the tapered mandrel bar may be operated in one of the following manners.

The first manner is described below with reference to a full retracting mandrel mill indicated by reference numeral 16 in FIG. 3. The tapered mandrel bar 3 inserted into the hollow piece 5 is retained at a feeding speed controlled in such a way that until the leading end of the hollow shell reaches the final stand 18, the mandrel bar will project from the delivery end of the final stand at all times by a predetermined length L. In the subsequent period that starts with the gripping of the leading end of the hollow shell 5 by the rolls in the final stand 18 and which ends with the trailing end of the same hollow shell leaving the final stand 18, the feeding of the mandrel bar 3 is ceased with the projecting length L being maintained. In other words, the mandrel bar 3 is kept projecting beyond the delivery end of the final stand by a predetermined length L not only at the point of time when the leading end of the hollow shell is gripped by the rolls in the final stand but also at the point of time when the elongating operation is completed. Otherwise, the wall thickness of the hollow shell 5 will gradually decrease as the rolling operation progresses.

In the first manner described above, the roll opening, especially the opening of the rolls in the final stand 18 is invariable and, hence, the wall thickness of the hollow shell 5 can be set at any value by controlling the outside diameter of the mandrel bar, namely, the position of the mandrel bar as determined by the length L by which it projects beyond the final stand.

After the elongating operation is completed, the mandrel bar 3 is pulled back by means of the mandrel bar retainer C-1 (see FIG. 1).

Figure 3:
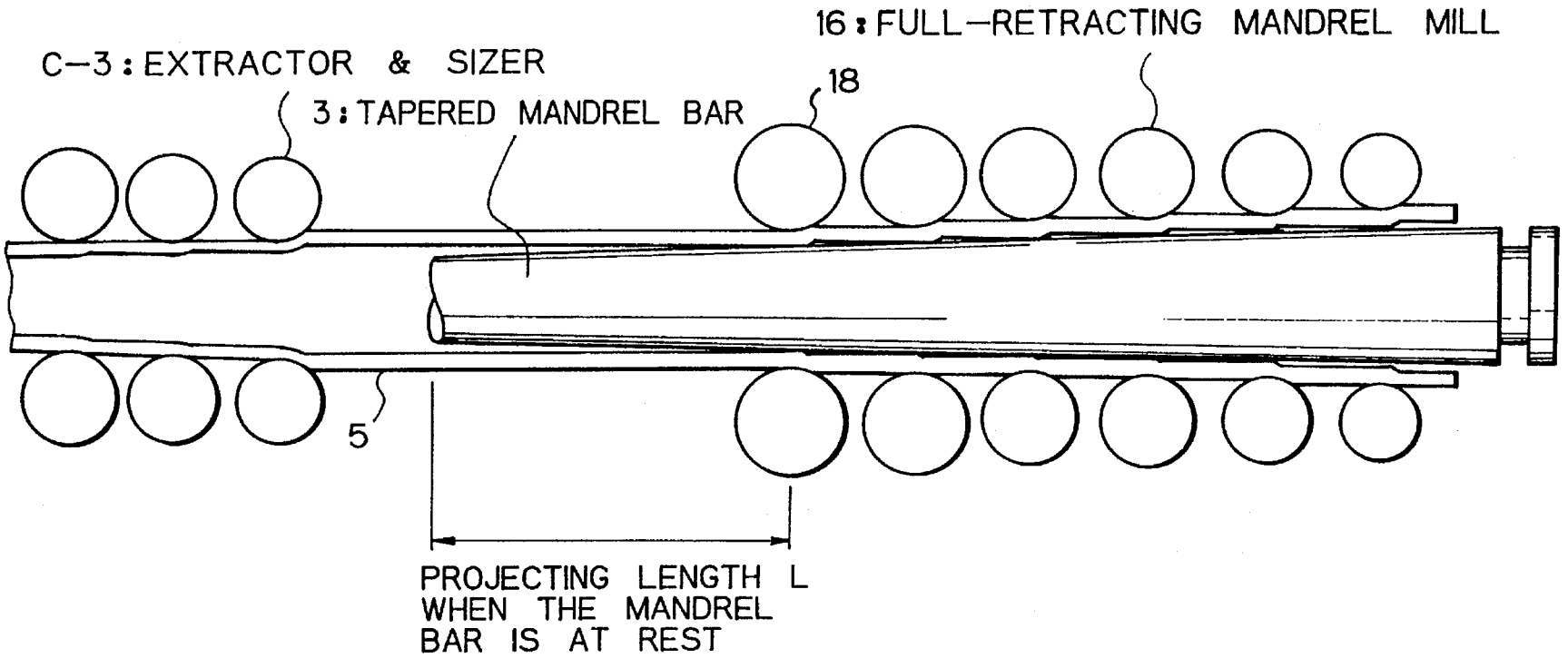
FIG. 3 is a sketch showing an example of the operation of the tapered mandrel bar according to the present invention, with the mandrel bar being brought to a stop during rolling.

If the elongating operation is to be performed with the roll opening invariable as in the case shown in FIG. 3, a shouldered mandrel bar may be substituted for the tapered mandrel bar and it goes without saying that the mandrel bar can be made to float within the range of the shoulder length. This arrangement for partial floating provides an effective measure against galling.

The hollow shell 5 thus controlled for wall thickness is then extracted by means of extractor C-3. Alternatively, it may optionally be sized by a sizing mill or stretch reducer E (see FIG. 1).

The second manner of operating the tapered mandrel bar is used when the mandrel bar is kept afloat from the start to the end of the elongating operation.

Figure 4:
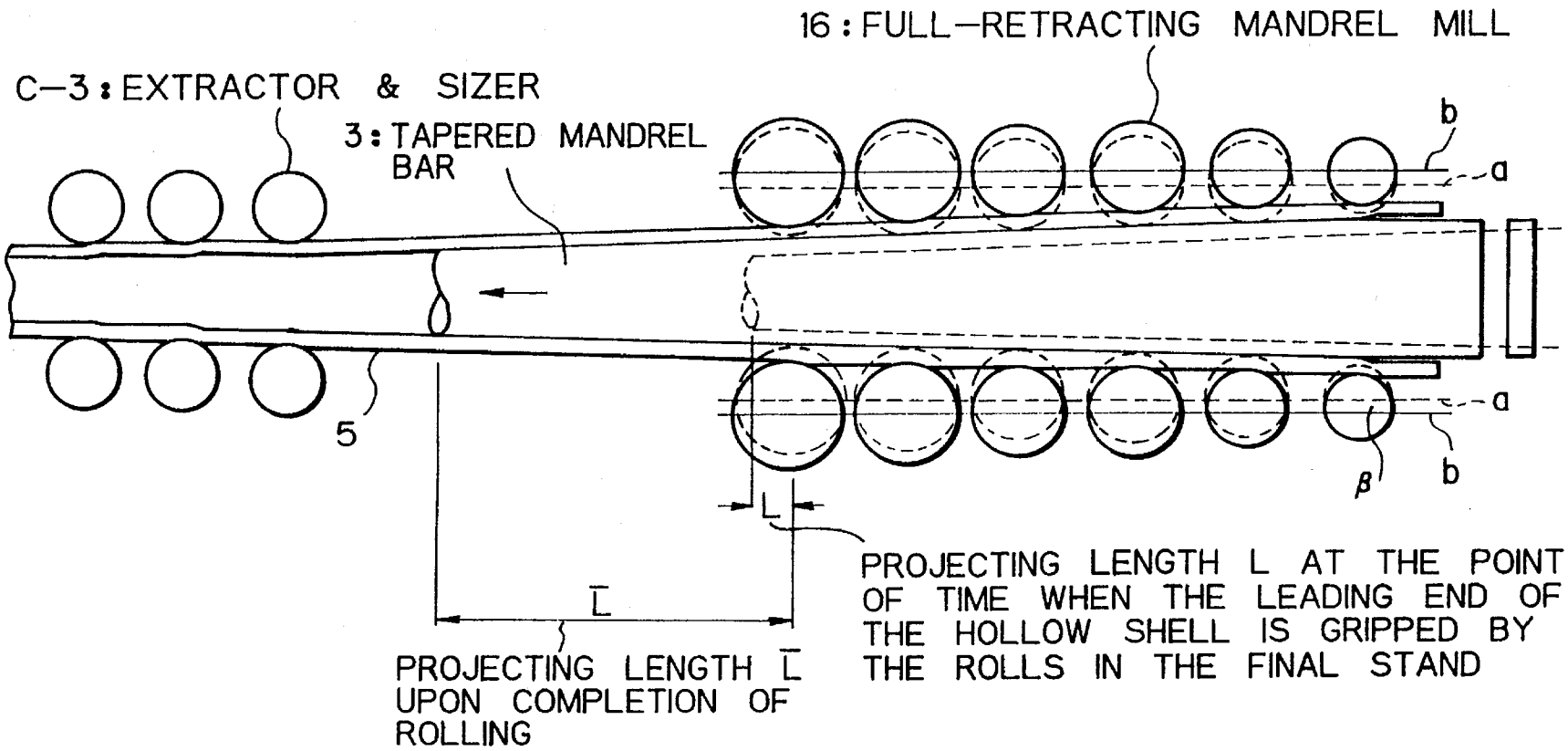
FIG. 4 is a sketch showing another example of the operation of the tapered mandrel bar according to the present invention, with the mandrel bar being kept in a semi-floating state during rolling.

If the tapered mandrel bar 3 is caused to float during the elongating operation, the roll opening is controlled as shown in FIG. 4 so that the wall thickness of the hollow shell 5 will not decrease as the rolling operation progresses. More specifically, in order to provide a uniform wall thickness in the longitudinal direction, the rolling openings of all stands are controlled to increase simultaneously by sufficient amounts to compensate for the amount of taper of the tapered mandrel 3. Referring to FIG. 4, the initial roll opening indicated by a dashed line a is changed by amount $\beta$ indicated by a solid line b, and this change is effected for all stands simultaneously.

In this second manner of operation, the feeding speed of the tapered mandrel bar is preferably controlled to be slower than the travelling speed of the hollow shell 5 at all times during rolling.

The thus elongated hollow shell 5 will have a desired wall thickness that is determined by the projecting length L and the roll opening of each stand (L is the length by which the tapered mandrel bar 3 projects beyond the delivery end of the final stand at the point of time when the leading end of the hollow shell 5 is gripped by the rolls in the final stand). After the end of the elongating operation, the mandrel bar is immediately pulled back by means of the mandrel bar retainer C-1 shown in FIG. 1.

In the step of elongating the shell by means of a mandrel mill, the quality of the inner surface of shells is generally better when the mandrel bar is kept afloat than when it is stopped in the course of rolling. Therefore, if one does not want to stop the mandrel bar in the course of rolling, the tapered mandrel bar is preferably controlled in the second manner just described above. Namely, the elongating operation is performed as the tapered mandrel bar is kept afloat and its feeding speed is controlled in such a way that at the point of time when the leading end of the hollow shell is gripped by the rolls in the final stand, the mandrel bar will project beyond the delivery end of the final stand by a predetermined amount L. At the same time, the roll openings of all stands are increased simultaneously so as to compensate for the amount of taper of the tapered mandrel bar, whereby a uniform distribution in wall thickness can be achieved in the longitudinal direction of the hollow shell.

In FIG. 4, $\bar{L}$ indicates the projecting length of the tapered mandrel bar 3 upon completion of rolling, i.e., the projecting length of the mandrel bar 3 at the point of time when the trailing end of the hollow shell leaves the final stand.

When using a straight tapered mandrel bar having a linear taper of $\delta$ on one side, a uniform wall thickness distribution can be attained in the longitudinal direction by increasing the roll openings of all stands simultaneously at a speed of $v \times \delta$, with reference being made to the point of time when the leading end of the hollow shell is gripped by the rolls in the final stand. In the formula just described above, v denotes the feeding speed of the mandrel bar.

In this case, the outside diameter of the hollow shell increases in the longitudinal direction but the change is sufficiently small to permit sizing to a predetermined outside diameter by means of extractor sizer C-3 in the next step. Needless to say, extractor sizer C-3 having no mandrel bar in contact with the inner surface of the hollow shell has no problem at all in association with the reduction of the outside diameter.

When controlling the roll openings of the stands, the rotating speed of the rolls in each stand is desirably adjusted in such a way that a constant volume speed is attained in accordance with the variation in the roll opening, whereby it is assured that neither a compressive force nor a tensile force will be applied between stands.

The foregoing description concerns a control method by which many sizes of wall thickness are assured for the hollow shell using a single tapered mandrel bar that decreases in outside diameter in the direction of advance of the rolling operation. It should be noted here that using a reverse-tapered mandrel bar which increases in outside diameter in the direction of advance of the rolling operation is also possible provided that certain conditions are satisfied. However, this makes it difficult to insert the mandrel bar into the hollow piece.

In certain cases, the feeding speed of the mandrel bar may be controlled in such a way that the feeding speed is kept faster than the speed of the hollow shell in both transient states (i.e., gripping of the leading end of the hollow shell by the rolls in the final stand and the emergence of the trailing end of the hollow shell from the final stand) and the steady state and yet it is possible to maintain the direction of a frictional force constant between the inside surface of the hollow shell and the mandrel bar (in this case, the direction of the frictional force is reversed). However, this is not economically a wise approach since it increases unavoidably the length of the mandrel bar.

While the elongation method of the present invention has been described above with particular reference being made to a common two-roll mandrel mill, it should of course be understood that the method is applicable to all types of mandrel mills including three-roll and four-roll mills.

The taper of the tapered mandrel bar used in the present invention may be either linear or nonlinear. All that is needed is for the diameter of the mandrel bar to decrease progressively toward the delivery end of the mandrel mill. Compared to a mandrel bar with a nonlinear taper, a linearly tapered mandrel bar is simpler to handle and therefore preferred. A taper of about 1/1000–2/1000 on one side is sufficient, and as will be clear from the examples that follow, by providing a taper of this order for the outside diameter of a mandrel bar, the number of mandrel bars that have to be kept in stock for manufacturing seamless steel tubes of many sizes ranging from a small to a large diameter can be drastically reduced to less than a tenth of the number that has heretofore been necessary.

The present invention is typically applicable to the retained mandrel mill of a semi-floating or full retracting type. However, when the present invention is applied to the early full floating type, the stomach formation of shells is unavoidable and a longer mandrel bar is necessary. It is also rather difficult to control the position of the mandrel bar.

The following examples are provided for the purpose of further illustrating the advantages of the present invention but are in no way to be taken as limiting.

EXAMPLE 1

The method of the present invention was implemented in the manner shown in FIG. 3.

A full retracting six-stand mandrel mill (stand spacing=1200 mm, roll diameter on each stand=600 mm) equipped with a mandrel bar retainer and a two-roll extractor was operated using a straight tapered mandrel bar having a linear taper of 2 mm per 1000 mm on one side. A hollow piece of carbon steel (JIS S50C) having an outside diameter of 185 mm and a wall thickness of 15 mm was elongated to a hollow shell by controlling the feeding speed of the mandrel bar in such a manner that the length L by which the mandrel bar would project beyond the delivery end of the final sixth stand at the time when the leading end of the hollow shell was gripped by the rolls in the final stand was varied in ten stages at intervals of 500 mm. Then, the outside diameter of the hollow shell was reduced to 155 mm through the three-stand extractor, whereby a total of ten product sizes including 8, 7.5, 7.0, . . . , 4 and 3.5 mm in wall thickness were selectively provided. The travelling speed of the hollow shell entering the first stand was 1 m/sec.

In Example 1, the mandrel bar was advanced at a smaller speed than the travelling speed of the hollow shell until the leading end of the hollow shell was gripped by the rolls in the final or sixth stand of the mandrel mill. Thereafter, the mandrel bar was at rest until the trailing end of the hollow shell left the final stand, thereby bringing the process of elongation to completion. After the end of the rolling operation, the mandrel bar was pulled back.

As already mentioned above, if the feeding of the mandrel bar is ceased, galling is likely to occur on account of the friction between the inner surface of the hollow shell and the outer surface of the mandrel bar. To avoid this problem, the surface of the mandrel bar used in Example 1 was nitrided, thereby reducing the coefficient of friction with the inner surface of the shell.

The roll pass design in Example 1 was specifically adapted for the thin-walled portion which was the most difficult to roll. Therefore, the rolling operation was entirely free from troubles related to metal flow such as pitting, over-filling, and buckling.

If parallel mandrel bars were used as in the prior art, as many as ten sizes of mandrel bar would be necessary since the diameter must be varied for every decrement of 0.5 mm in wall thickness. According to the present invention, only one tapered mandrel bar was used and yet ten sizes of hollow shell with different wall thicknesses could successfully be elongated without causing any troubles.

EXAMPLE 2

The method of the present invention was implemented in the manner shown in FIG. 4.

A full retracting six-stand mandrel mill of the same specifications as in Example 1 was operated using a straight tapered mandrel bar having a linear taper of 1 mm per 1000 mm on one side. With this mandrel bar inserted into a hollow piece of alloy steel (13Cr steel) having an outside diameter of 185 mm and a wall thickness of 15 mm, the hollow piece was elongated to a hollow shell while the mandrel bar was kept afloat ("semi-floating" to be exact) as it was retained from the rear so that it could be advanced at a speed of 0.5 m/sec with respect to the shell speed of 1 m/sec at the entry end of the first stand. Subsequently, the outside diameter of the hollow shell was reduced to 155 mm through the three-stand extractor/sizer, whereby a total of ten product sizes including 8, 7.5, 7, . . . , 4 and 3.5 mm in wall thickness were selectively provided.

In the operation described above, the feeding speed of the mandrel bar was controlled in such a way that the length by which the mandrel bar projected beyond the delivery end of the final stand at the point of time when the leading end of the hollow shell was gripped by the rolls in the final stand increased by successive increments of 500 mm.

Then, on the basis of the reference point of time at which the leading end of the hollow shell was gripped by the rolls in the final stand, the roll openings of all stands were increased simultaneously at a rate of 0.5 mm/sec in synchronism with the mandrel bar feed speed (v) of 0.5 m/sec by such amounts as to cancel the taper of the mandrel bar, whereby a uniform wall thickness was provided for the hollow shell in the longitudinal direction. After the end of the rolling operation, the mandrel bar was pulled back.

Since the roll openings of all stands were increased simultaneously at a constant rate during the elongating operation, the outside diameter of the hollow shell increased gradually to produce a taper. However, with the rolling time being only about 10 seconds, the shell would bulge out by only about 10 mm, and such a small difference in outside diameter could effectively be absorbed by the extractor/sizer at the next stage to achieve sizing to the same outside diameter.

In Example 2, the mandrel bar was kept afloat during the elongating operation, so even a stainless steel which had an inherent tendency to experience "galling" could be rolled without this problem occurring, thus producing hollow shells having very good properties on their inner surfaces.

The use of the tapered mandrel bar in Example 2 also enabled ten sizes of hollow shell with different wall thicknesses to be elongated satisfactorily.

When producing many sizes of metal tubes on a mandrel mill, it has been necessary in the prior art to provide a large number of mandrel bars of different diameters that are selectively used as the wall thickness of the hollow shell varies by 0.5 mm. With the improved method of operating a tapered mandrel bar according to the present invention, diameter variation of mandrel bars on a wider pitch of 5 mm suffices, whereby the number of mandrel bars that have to be kept in stock is drastically reduced to a tenth of the heretofore required number.

As a result, the need for an automated warehouse to accommodate a huge number of mandrel bars is eliminated. Therefore, not only can initial investment be markedly reduced but the required maintenance of mandrel bars is also reduced significantly to achieve a corresponding decrease in running costs. Hence, the economic effects of the present invention are outstanding.

What is claimed is:

1. A method of elongating a metal tube by way of a mandrel mill having a series of rolling stands provided with rolls, including a final rolling stand having a delivery end, to produce a hollow shell, comprising inserting a tapered mandrel bar into a hollow piece, rolling the hollow piece through the rolling stands, and controlling a feeding speed of the mandrel bar to control a length by which the mandrel bar projects beyond the delivery end of the final rolling stand at a point in time when a leading end of the hollow piece is gripped by the rolls in the final rolling stand so that a wall thickness of the hollow piece is altered to permit the production of hollow shells of a plurality of sizes with different wall thicknesses using a single mandrel bar.

2. A method according to claim 1, wherein the step of controlling the feeding speed of the mandrel bar includes controlling the feeding speed of the mandrel bar to be slower than a travelling speed of the hollow piece.

3. A method according to claim 1, including controlling the the rolls in each rolling stand to revolve at revolution speeds to provide a constant volume speed in accordance with a change in cross-sectional area of the hollow piece in each rolling stand.

4. A method according to claim 1, wherein the step of controlling the feeding speed of the mandrel bar includes controlling the feeding speed of the mandrel bar so that feeding of the mandrel bar is ceased at a point in time when the leading end of the hollow piece is gripped by the rolls in the final stand.

5. A method according to claim 4, wherein said step of inserting a tapered mandrel bar into a hollow piece includes inserting a shouldered mandrel bar into a hollow piece.

6. A method according to claim 1, including controlling an opening between the rolls in each rolling stand to compensate for an amount of taper of the tapered mandrel bar in accordance with the length by which the mandrel bar projects beyond the delivery end of the final stand at the point in time when the leading end of the hollow piece is gripped by the rolls in the final rolling stand to thereby assure a uniform wall thickness for the hollow shell in a longitudinal direction of the hollow shell.

7. A method according to claim 6, including continuing the feeding of the mandrel bar in such a way that the length by which the mandrel bar projects beyond the delivery end of the final rolling stand assumes a predetermined length at the point in time when a trailing end of the hollow shell leaves the final rolling stand.

8. A method according to claim 6, wherein the step of controlling the feeding speed of the mandrel bar includes controlling the feeding speed of the mandrel bar to be slower than a travelling speed of the hollow shell at all times during rolling.

9. A method according to claim 6, including controlling revolution speeds of the rolls in each stand to provide a constant volume speed in accordance with a change in cross-sectional area of the hollow piece at each stand.

10. A method of elongating a metal tube by way of a mandrel mill having a series of rolling stands provided with rolls, including a final rolling stand having a delivery end, to produce a hollow shell, comprising inserting a tapered mandrel bar into a hollow piece, rolling the hollow piece through the rolling stands, controlling a feeding speed of the mandrel bar to control a length by which the mandrel bar projects beyond the delivery end of the final rolling stand at a point in time when a leading end of the hollow piece is gripped by the rolls in the final rolling stand, and ceasing the feed of the mandrel bar at a point in time when the leading end of the hollow piece is gripped by the rolls in the final rolling stand so that a wall thickness of the hollow piece is altered to permit the production of hollow shells of a plurality of sizes with different wall thicknesses using a single mandrel bar.

11. A method according to claim 10, wherein the step of controlling the feeding speed of the mandrel bar includes controlling the feeding speed of the mandrel bar to be slower than a travelling speed of the hollow piece.

12. A method according to claim 10, including controlling revolution speeds of the rolls in each stand to provide a constant volume speed in accordance with a change in cross-sectional area of the hollow piece at each rolling stand.

13. A method according to claim 10, wherein the step of inserting a tapered bar into a hollow piece includes inserting a shouldered mandrel bar into the hollow piece.

14. A method of elongating a metal tube by way of a mandrel mill having a series of rolling stands provided with rolls, including a final rolling stand which has a delivery end, to produce a hollow shell, comprising inserting a tapered mandrel bar into a hollow piece, rolling the hollow piece through the rolling stands, controlling a feeding speed of the mandrel bar to control a length by which the mandrel bar projects beyond the delivery end of the final rolling stand at a point in time when a leading end of the hollow piece is gripped by the rolls in the final rolling stand, and controlling an opening between the rolls in each stand to compensate for an amount of taper of the tapered mandrel bar in accordance with the length by which the mandrel bar projects beyond the delivery end of the final rolling stand at the point in time when the leading end of the hollow piece is gripped by the rolls in the final rolling stand so that a wall thickness of the hollow piece is altered to permit the production of hollow shells of a plurality of sizes with different wall thicknesses using a single mandrel bar.

15. A method according to claim 14, wherein the feeding of the mandrel bar is continued in such a way that the length by which the mandrel bar projects beyond the delivery end of the final rolling stand will assume a predetermined length at the point of time when a trailing end of the hollow piece leaves the final rolling stand.

16. A method according to claim 14, wherein said step of controlling the feeding speed of the mandrel bar includes controlling the feeding speed of the mandrel bar to be slower than a travelling speed of the hollow piece at all times during rolling of the hollow piece.

17. A method according to claim 14, wherein the rolls in each stand revolve at revolution speed that are controlled to provide a constant volume speed in accordance with a change in cross-sectional area of the hollow piece in each rolling stand.

18. A system for elongating a metal tube comprising a mandrel mill that includes a series of rolling stands each provided with rolls for rolling a hollow piece to produce a hollow shell, a tapered mandrel bar positionable in an interior of the hollow shell, and a controller for controlling a feeding speed of the tapered mandrel bar to thereby permit production of hollow shells of a plurality of sizes with different wall thicknesses using a single mandrel bar.

* * * * *